US011524810B2

(12) United States Patent
Giuliani

(10) Patent No.: US 11,524,810 B2
(45) Date of Patent: Dec. 13, 2022

(54) LABELLING MACHINE AND METHOD FOR HANDLING A WEB-LIKE LABELLING MATERIAL IN AN AUTOMATED LABELLING PROCESS

(71) Applicant: SIDEL PARTICIPATIONS, Octeville-Sur-Mer (FR)

(72) Inventor: Mattia Giuliani, Mantova (IT)

(73) Assignee: SIDEL PARTICIPATIONS, Octeville-sur-mer (FR)

( * ) Notice: Subject to any disclaimer, the term of this patent is extended or adjusted under 35 U.S.C. 154(b) by 0 days.

(21) Appl. No.: 17/290,250

(22) PCT Filed: Oct. 14, 2019

(86) PCT No.: PCT/EP2019/077718
§ 371 (c)(1),
(2) Date: Apr. 29, 2021

(87) PCT Pub. No.: WO2020/088919
PCT Pub. Date: May 7, 2020

(65) Prior Publication Data

US 2022/0017253 A1 Jan. 20, 2022

(30) Foreign Application Priority Data

Oct. 30, 2018 (EP) ..... 18306416

(51) Int. Cl.
*B65C 9/42* (2006.01)
*B65C 9/18* (2006.01)

(52) U.S. Cl.
CPC ..... *B65C 9/42* (2013.01); *B65C 9/1819* (2013.01)

(58) Field of Classification Search
CPC ..... B65C 9/42; B65C 9/1819; B65C 9/1815; B65C 9/1803; B65C 9/18; B65C 9/40
See application file for complete search history.

(56) References Cited

U.S. PATENT DOCUMENTS 5,968,303 A 10/1999 Nagasaka
2015/0035228 A1* 2/2015 Carmichael ..... B65C 9/1819 156/64

FOREIGN PATENT DOCUMENTS

DE 202018105023 U1 10/2018
WO 2012001831 A1 1/2012

OTHER PUBLICATIONS

Translation of DE202018105023U1, Sidel Participations SAS, Oct. 23, 2020 (Year: 2020).*
International search report dated Nov. 29, 2019.

* cited by examiner

*Primary Examiner* — George R Koch

(57) ABSTRACT

The invention relates to a labelling machine for applying labels onto articles intended to contain a pourable product and comprising a conveyor and a transfer element. The labelling machine also comprises first detection means, arranged peripherally to the transfer element in a position downstream of an application station and upstream of a receiving station, relatively to an advancement direction. The first detection means is configured to detect the single labels still retained in use and to generate a presence signal correlated with the presence of the labels, by the lateral surface downstream of the application station. The labelling machine comprises second detection means arranged in a position downstream of the receiving station and upstream of the application station, relatively to the advancement direction, and configured to detect a positioning of each label onto the lateral surface and to generate a positioning signal correlated with the positioning of each label.

19 Claims, 3 Drawing Sheets

LABELLING MACHINE AND METHOD FOR HANDLING A WEB-LIKE LABELLING MATERIAL IN AN AUTOMATED LABELLING PROCESS

This application is a 371 of PCT/EP2019/077718, filing date Nov. 10,2019.

TECHNICAL FIELD

The present invention relates to a labelling machine for handling a web-like labelling material in an automated labelling process, in particular to a labelling machine configured for applying labels onto articles, such as bottles, containers, or the like.

The present invention also relates to a method for handling a web-like labelling material in an automated labelling process during which labels are applied onto articles, such as bottles, containers, or the like.

BACKGROUND ART

Labelling machines are known, which are commonly used to transport, prepare and apply labels onto articles, such as bottles, containers, or the like destined to be filled with a pourable product, in particular a pourable food product.

Particularly widespread is the use of glued labels, i.e. portions of a labelling material that are cut at appropriate lengths from a web of labelling material wound around one or more coils.

In detail, the web of labelling material is cut in labels of equal length, upon which glue is applied by gluing means (such as a gluing roller, spray and injector systems or the like) and which, finally, are conveyed and applied onto respective articles.

According to an alternative mode of carrying out the labelling process, sleeve labels, i.e. tubular-like labels, are obtained from a web of heat-shrinkable labelling material.

In particular, such sleeve labels are applied onto the respective articles with a certain backlash and then are heated up in an oven, so as to cause them to shrink and perfectly adhere onto the lateral surfaces of the same articles. This last configuration does not require the use of any glue or gluing means.

Regardless of the type of label, a known labelling machine typically comprises:

- a rotary carousel, rotatable around a vertical axis and configured to convey a plurality of articles along an horizontal, arc-shaped transfer path;
- an input station, at which the articles to be labelled are fed to the carousel;
- an output station, at which the labelled articles exit the carousel; and
- a labelling module, peripherally arranged relatively to the carousel and configured to feed a plurality of labels to the carousel itself at an application station, in order to apply such labels to respective articles.

Generally, the labelling module comprises:

- one or more storage units, for example reels or coils around which the web of labelling material is wound;
- a plurality of unwinding rollers, which support, in use, the web progressively unwound from the reels and guide it, in use, along a feeding path;
- a cutting device, for example a knife, configured to cut a sequence of single labels having equal length from the web of labelling material; and

- a vacuum drum configured to receive, retain and advance each label previously cut by the cutting device and to feed each label to the carousel, at the application station.

Typically, the labelling module further comprises at least one transfer roller, configured to receive the web from the unwinding rollers and to transfer a plurality of labels obtained from such web to the vacuum drum. Generally, the cutting device is arranged peripherally to such transfer roller.

In case that the glue labels are used, the labelling module further comprises gluing means, usually a gluing roller arranged peripherally to the vacuum drum, in particular substantially tangent to the vacuum drum, and configured to apply glue at least onto the end portions (leading end portion and trailing end portion) of each label advanced by the same vacuum drum.

Normally, the vacuum drum has an approximately cylindrical or toroidal lobed configuration and is mounted, in a rotatable manner about its axis, on a stationary distributor member of the labelling module.

In detail, the vacuum drum is configured to receive and retain a succession of labels, previously cut by the cutting device at a receiving station and, after a rotation of a certain angle about its axis, to release the labels at the application station, so that such labels can be applied onto respective articles advanced by the carousel.

Accordingly, the carousel, the vacuum drum, the gluing roller and the transfer roller are conveniently phased and synchronized in order to correctly perform the whole labelling operation.

According to some configurations known in the art, the stationary distributor member has first air passages connected to a vacuum source; the vacuum drum is in turn provided with second air passages, which are configured to communicate with the first air passages at certain angular positions of the drum as it rotates about its axis, and end into a plurality of vacuum ports formed through an outer lateral surface of the drum for receiving the labels.

More precisely, the vacuum ports are formed in a plurality of damping pads (leading damping pads and trailing damping pads) and intermediate sections which, together, define the outer lateral surface of the vacuum drum.

In detail, the pads are organized in pairs, each pair including a leading pad, a trailing pad and an intermediate section between these latter.

In practice, when being retained by the vacuum drum, a label shall typically have the leading end held on one leading pad, the trailing end held on one trailing pad and the remaining (intermediate) part held on a section of the outer lateral surface comprised between the two mentioned pads (i.e., the corresponding intermediate section).

In light of the above, the distance between a leading pad and a trailing pad is substantially equal to the length of the strip of labelling material, i.e. the label, to be processed as measured along the circumference of the vacuum drum.

Furthermore, the height of the vacuum drum is approximately equal to the height of the label to be processed as measured parallel to the rotation axis of the vacuum drum. In practice, the height of the vacuum drum is slightly less than the height of the label to be processed, so that the upper and lower edges of the label overhang the vacuum drum by a few millimetres, which helps prevent glue from contaminating the vacuum drum surface.

It is known in the field of labelling machines the undesired eventuality in which a label is not applied onto the relative article and, therefore, remains stuck onto the vacuum drum despite having passed the application station (unapplied label). This condition can happen mainly for the following reasons:

- the article is not present on the carousel or it is not in the nominal position in which it should be in nominal operating conditions; or
- the article is present on the carousel but the label is not applied thereon due to an excess of glue applied by the gluing roller; and/or
- the article is present on the carousel but the label is not applied thereon because of a non-nominal positioning of the label onto the vacuum drum, for example because of a cutter-related fail or a vacuum-related fail.

Regardless of the reason, the unapplied labels can cause overlapping of other subsequent labels fed to the vacuum drum in the same positions between the pairs of pads retaining the unapplied labels.

This can lead to production jammings, waste of labelling material and, in the case of non-nominally positioned labels, glue spread onto the surface of the vacuum drum.

In order to avoid the aforementioned problems, according to a known solution labelling machines comprise detection means arranged peripherally to the vacuum drum in a position downstream of the application station and upstream of the receiving station and configured to detect the presence of labels onto the vacuum drum downstream of the application station and to generate a presence signal correlated with the presence of such labels downstream of the application station.

In detail, the detection means, usually consisting in one or more optical sensors, generate a presence signal when the presence of an unapplied label onto the vacuum drum downstream of the application station is detected. This presence signal is then sent to a control unit, which, on the basis of the presence signal received from the detecting means, commands the labelling machine to stop.

In this way, production jammings, waste of labelling material and unnecessary and unwanted glue waste and spreading are avoided.

Together with the control signal, the detection means generate an alarm signal, alerting the operator that a problem has occurred.

Although being functionally valid, the above-described solution leaves room to further improvement. In particular, a need is felt to perform an easy, cost-effective and time-effective troubleshooting of the causes due to which labels are not applied onto articles and are still retained onto the vacuum drum despite having passed the application station.

DISCLOSURE OF INVENTION

It is therefore an object of the present invention to provide a labelling machine, which is designed to meet the above-mentioned need in a straightforward and low-cost manner.

This object is achieved by a labelling machine as claimed in claim 1.

It is another object of the present invention to provide a method of labelling, which is designed to meet the above-mentioned need in a straightforward and low-cost manner.

This object is achieved by a method of labelling as claimed in claim 14.

BRIEF DESCRIPTION OF THE DRAWINGS

Two non-limiting embodiments of the present invention will be described by way of example with reference to the accompanying drawings, in which.

BEST MODE FOR CARRYING OUT THE INVENTION

Figure 1:
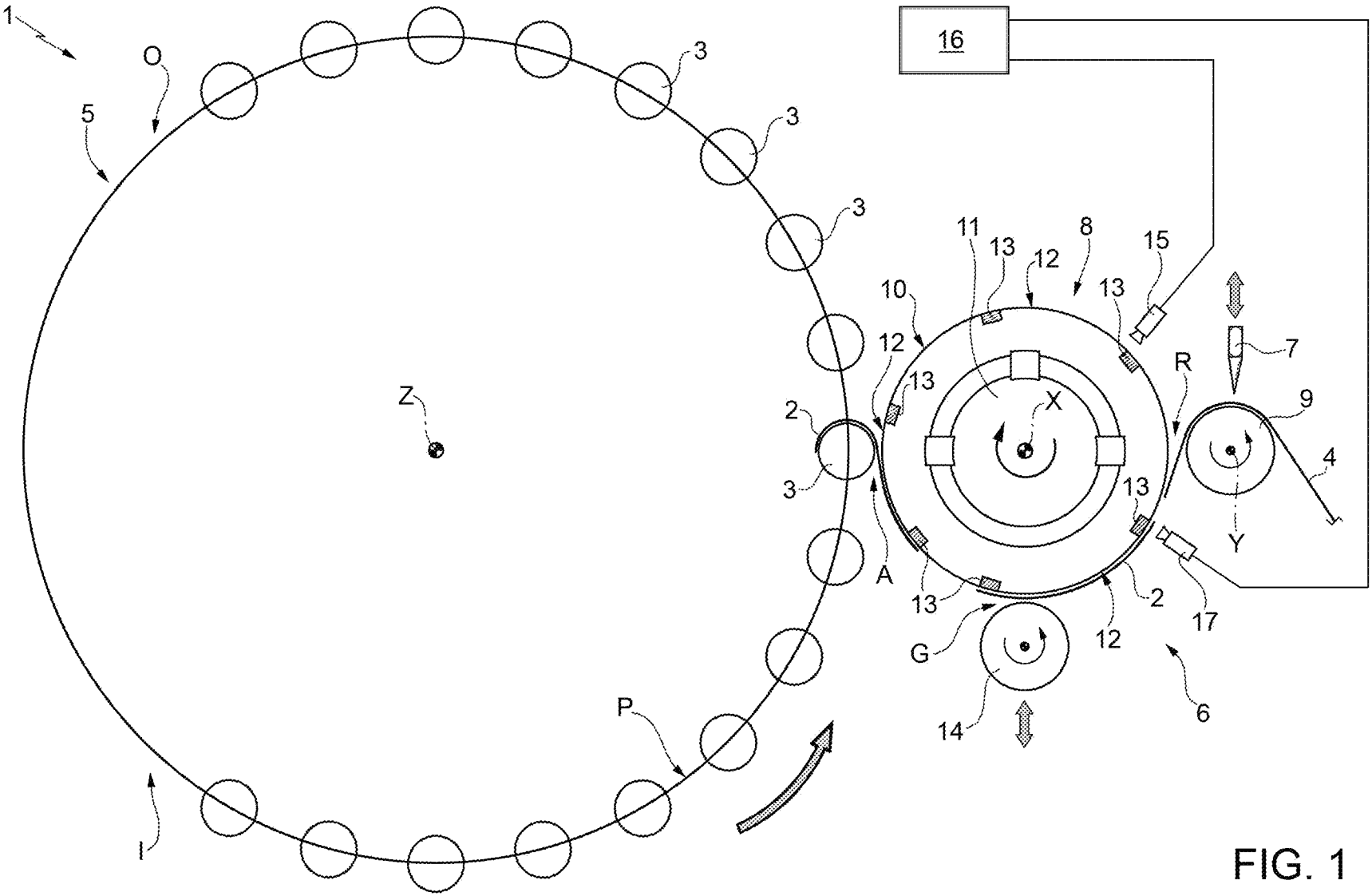
FIGS. 1 to 3 are schematic and simplified top views of a labelling machine according to a first embodiment of the present invention, during different operating conditions.
Figure 3:
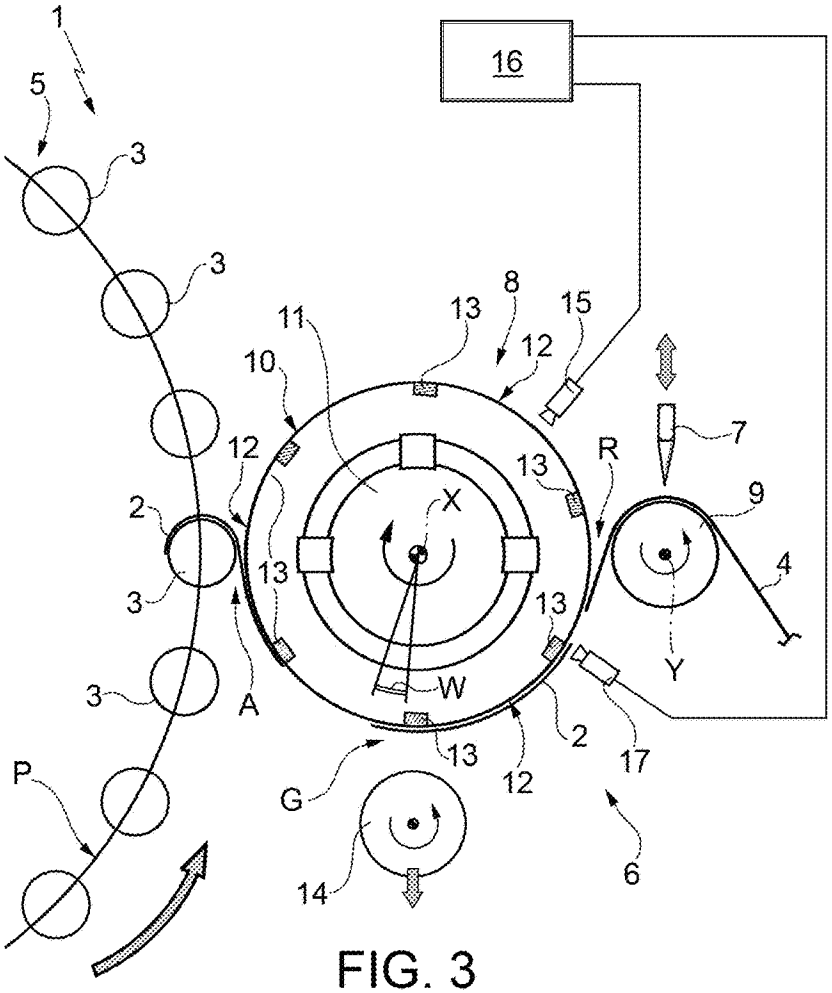
Figure 2:
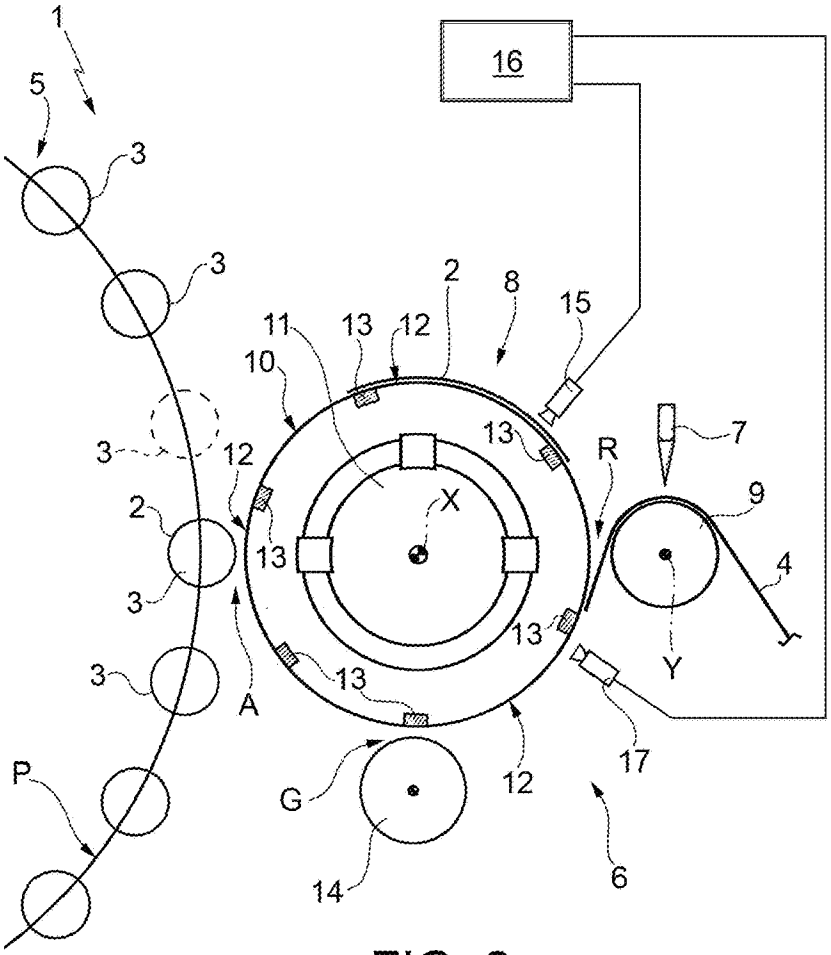
Figure 5:
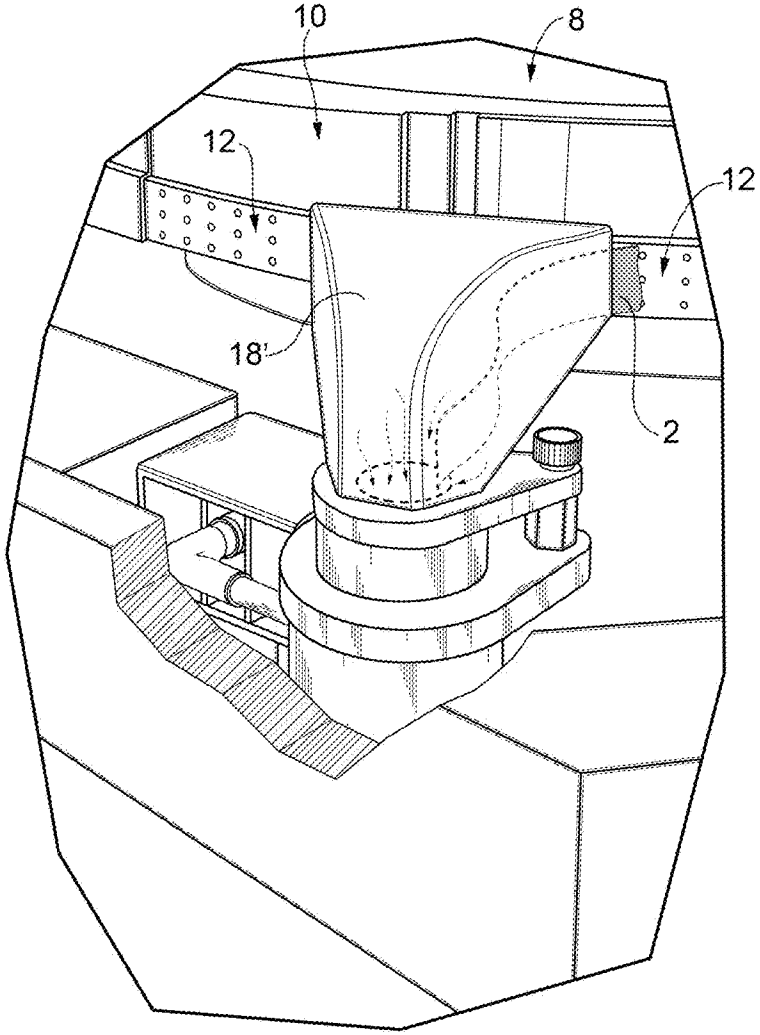
FIG. 5 is a larger-scale perspective view of a detail of the labelling machine of FIG. 4.

With reference to FIGS. 1 to 3, number 1 indicates as a whole a labelling machine configured to apply labels 2 onto articles 3, such as bottles, receptacles, or the like, destined to contain a pourable product, in particular a pourable food product.

According to this non-limiting preferred embodiment, labels 2 applied by labelling machine 1 are glued labels, i.e. strips of labelling material that are cut at predetermined lengths, from a web 4 of labelling material, and to which glue is applied.

Preferably, web 4 of labelling material is wound around one or more storage units, such as coils or reels (known per se and not shown).

According to an alternative preferred embodiment not shown, labelling machine 1 handles sleeve labels, i.e. tubular-like labels obtained from a web of heat-shrinkable labelling material. In particular, such sleeve labels are applied onto the respective articles 3 with a certain predetermined backlash and then are heated up in an oven, so as to cause them to shrink and perfectly adhere onto the lateral surfaces of the same articles 3.

Labelling machine 1 substantially comprises:

- a conveyor, preferably a rotary carousel 5 rotatable around an axis, in particular a vertical axis Z, and configured to advance a plurality of articles 3 along a transfer path P, in the example shown an arc-shaped, horizontal transfer path;
- an input station I, at which articles 3 to be labelled are fed to carousel 5;
- an output station 0, at which labelled articles 3 exit from carousel 5; and
- a labelling module 6 (only partially and schematically shown), arranged peripherally to carousel 5 and configured to feed a plurality of labels 2 to the carousel 5 itself at an application station A, in order to apply labels 2 to respective articles 3.

In detail, labelling module 6 comprises:

- one or more of the above mentioned storage reels;
- a plurality of unwinding reels (not shown), which support, in use, the web 4 progressively unwound, in use, from the storage reels and guide it along a feeding path;
- a cutting device, preferably a knife 7, configured to cut a sequence of single labels 2 from web 4, in the form of strips having equal length;
- a transfer element, in particular a transfer drum, even more in particular a rotary vacuum drum 8 rotatable around an axis, preferably a vertical axis X, arranged peripherally to carousel 5 and configured to receive, retain and convey each label 2 previously cut by knife 7 and to feed each label 2 to carousel 5, at application station A; and
- a feeding element, in particular a rotary transfer roller 9, rotatable around an axis, preferably a vertical axis Y, arranged peripherally to vacuum drum 8 and configured to feed the sequence of labels 2 previously cut by knife 7.

In greater detail, vacuum drum 8 sequentially receives, in use, labels 2 from transfer roller 9 at a receiving station R and retains labels 2 on an outer lateral surface 10 thereof.

Preferably, vacuum drum 8 has a substantially cylindrical-toroidal lobed configuration. Accordingly, lateral surface 10 has a substantially cylindrical shape and labels 2 are conveyed circumferentially from receiving station R to application station A, along an advancement direction, in this specific example a direction of rotation of vacuum drum 8.

Furthermore, vacuum drum 8 is rotatably mounted around axis X onto a stationary distributor element 11 (schematically shown).

In detail, distributor element 11 comprises first air passages (not shown) connected to a vacuum source (not shown). Vacuum drum 8 is, in turn, provided with second air passage (also not shown), which are configured to selectively communicate with the first air passages at certain angular positions assumed by vacuum drum 8, as this latter rotates about axis X, and end into a plurality of vacuum ports (known per se and not shown) formed through lateral surface 10.

In practice, depending on the angular position assumed by vacuum drum 8, the vacuum ports are put in fluid communication, by means of the first and second air passages, with the vacuum source. When this happens, a suction is applied on label 2, which retains this latter onto lateral surface 10.

More precisely, the vacuum ports are distributed onto one or more receiving portions 12 of lateral surface 10, each one of which angularly extends onto lateral surface 10 relatively to axis X and is configured to receive and retain one label 2 at a time, so that such label 2 is superimposed, in use, onto the corresponding receiving portion 12.

In detail, each receiving portion 12 includes a pair of damping pads 13, in particular a leading pad and a trailing pad, angularly spaced from one another with respect to the direction of rotation of vacuum drum 8 about axis X and provided with the vacuum ports, and an intermediate section angularly comprised between pads 13.

In greater detail, pads 13 are configured to retain respective end portions of each label 2 by means of vacuum-generated suction.

In particular, the leading pads are configured to retain the leading end portion of labels 2, whereas the trailing pads are configured to retain the trailing end portion of labels 2.

Therefore, pads 13 define the end portions of each respective receiving portion 12.

In light of the above, the angular distance between a leading pad and a trailing pad of each pair of pads 13 is substantially equal to the length of labels 2 to be handled by vacuum drum 8.

According to the preferred embodiment described herein, labelling module 6 further comprises gluing means, in particular a gluing roller 14 arranged peripherally to vacuum drum 8, preferably substantially tangent to lateral surface 10, and configured to apply glue onto at least the end portions (leading end portion and trailing end portion) of each label 2 retained by receiving portion 12.

In detail, gluing roller 14 defines a gluing station G located downstream of receiving station R and upstream of application station A.

Labelling machine 1 further comprises first detection means, in this specific embodiment a first optical sensor 15 arranged peripherally with respect to vacuum drum 8 in a position downstream of application station A and upstream of receiving station R and configured to detect the labels 2 which, due to non-nominal operating conditions, are still retained by the corresponding receiving portions 12 downstream of application station A. Furthermore, first sensor 15 is configured to generate a presence signal correlated with the presence of labels 2 still retained by the corresponding receiving portions 12 downstream of application station A, and to send this latter signal to a control unit 16, which is in turn configured to receive the presence signal and, on the basis of such presence signal, to command labelling machine 1 to stop.

In practice, when non-nominal operating conditions occur, the transfer of one label 2 from vacuum drum 8 to carousel 5 at application station A could fail. This non-nominal operating conditions may be due to the fact that:

- relative article 3 is not present on carousel 5 or it is not in its nominal position in which it should be during nominal operating conditions; or
- relative article 3 is present on carousel 5 but label 2 is not applied thereon due to an excess of glue applied by gluing roller 14; and/or
- relative article 3 is present on carousel 5 but label 2 is not applied thereon because of a non-nominal positioning of label 2 onto the respective receiving portion 12, for example because of a cutting-related fail or a vacuum-related fail.

In these cases, such label 2 continues to be retained onto lateral surface 10, in particular onto the corresponding receiving portion 12 despite having passed application station A.

As soon as first sensor 15 detects the presence of such label 2, it generates the presence signal, which is then sent to control unit 16.

As shown in FIG. 2, control unit 16 commands the stop of labelling machine 1, in order to prevent waste of labelling material and unnecessary and undesired glue spreading onto vacuum drum 8.

In this way, possible undesired production jammings are avoided.

Reference is made hereinafter to a single label 2 fed by transfer roller 9 to vacuum drum 8 and which has to be applied onto a relative article 3.

However, all the functional and structural features described herein in relation to such label 2 and in connection with such label 2 are applicable to all labels 2 handled by labelling machine 1.

Advantageously, labelling machine 1 further comprises second detection means, in this specific embodiment a second optical sensor 17 arranged peripherally to vacuum drum 8 in a position downstream of receiving station R and upstream of application station A and configured to detect a positioning of label 2 onto lateral surface 10, in particular a positioning of label 2 relatively to receiving portion 12. Furthermore, second sensor 17 is configured to generate a positioning signal correlated with the positioning of this label 2 and, then, to send it to control unit 16.

More precisely, second sensor 17 retrieves, in use, information about the angular positioning of label 2, with respect to axis X, relatively to receiving portion 12.

In particular, second sensor 17 retrieves, in use, information about the angular positioning of label 2, with respect to axis X, relatively to pads 13.

Furthermore, control unit 16 is further configured to compare the positioning signal sent by second sensor with a predetermined nominal positioning, i.e. a nominal angular positioning, of label 2 onto lateral surface 10, in particular with a predetermined nominal angular positioning which label 2 should assume onto receiving portion 12, and between pads 13, in nominal operating conditions.

In this way, second sensor 17 allows to perform a troubleshooting of the causes due to which label 2 could not be applied onto the respective article 3 at application station A. In fact, if second sensor 17 does not detect any non-nominal positioning of label 2 relatively to receiving portion 12 (and pads 13), the cutting performed by knife 7 and any vacuum ports fail and/or any other fail which can occur during the transfer of such label 2 from transfer roller 9 to vacuum drum 8 have to be excluded.

In greater detail, second sensor 17 is capable of detect, in use, an angular offset, of a given angle W (FIG. 3) with respect to axis X, of label 2 with respect to receiving portion 12, i.e. a forward angular offset, of a given angle W, of label 2 with respect to the leading pad of receiving portion 12 or a backward angular offset, of a given angle W, of label 2 with respect to the trailing pad of the same receiving portion 12.

Moreover, control unit 16 is further configured to control an advancement, in particular a rotation, of said angle W, of vacuum drum 8 relatively to transfer roller 9, when the angular positioning detected by second sensor 17 differs, by the same angle W, from the nominal angular positioning.

Accordingly, when second sensor 17 detects a forward angular offset, of a given angle W, of label 2 with respect to the leading pad of receiving portion 12, control unit 16 controls, in use, a backward rotation, of the same angle W, of vacuum drum 8 relatively to transfer drum 9; whereas, when second sensor 17 detects a backward angular offset, of a given angle W, of label 2 with respect to the trailing pad of receiving portion 12, control unit 16 controls, in use, a forward rotation, of the same angle W, of vacuum drum 8 relatively to transfer drum 9.

In this way, if, due to non-nominal operating conditions, vacuum drum 8 is out of angular phase relatively to transfer drum 9, of an angle W, labelling machine 1 can provide an automatic angular re-phasing of vacuum drum 8.

As shown in FIGS. 1 to 3, second sensor 17 is conveniently arranged in a position downstream of receiving station R and upstream of gluing station G.

Therefore, second sensor 17 is configured to detect the angular positioning of label 2 onto lateral surface relatively to receiving portion 12 (and pads 13) upstream the gluing station G.

Consequently, the possible troubleshooting to be performed could be further improved: in fact, since second sensor 17 retrieves, in use, information on the angular positioning of label 2 prior to the application of glue onto this latter by gluing roller 14, if second sensor 17 does not detect any non-nominal positioning of label 2 relatively to receiving portion 12 and pads 13, the gluing operation performed by gluing roller 14 could, with reasonable probability, be the cause due to which label 2 has not been applied onto the relative article 3 at application station A.

Furthermore, control unit 16 is configured to control a movement of gluing roller 14 away from lateral surface 10, and therefore away from axis X and vacuum drum 18, when the angular positioning detected by second sensor 17 differs from the nominal angular positioning.

This condition is schematically shown in FIG. 3, where gluing roller 14 is moved away from vacuum drum 8.

In this way, an undesired application of glue onto a non-nominal label 2, i.e. a label 2 non-nominally positioned on vacuum drum 8, is avoided.

In addition, control unit 16 is configured to control the rotation of vacuum drum 8 relatively to transfer drum 9 after a given number (more than one) of subsequent labels 2 are detected by second sensor 17 to be forwardly or backwardly protruding from the corresponding receiving portions 12, i.e. when a constant angular offset, that is a constant angular positioning error of labels 2 with respect to the corresponding receiving portions 12, is detected.

By way of example, if second sensor 17 detects more than five labels 2 retained by the corresponding receiving portions 12 with a constant forward angular offset equal to angle W, control unit 16 will control a backward rotation, of the same angle W, of vacuum drum 8 relatively to transfer drum 9, so as to adjust the angular phasing of these latter.

The operation of labelling machine 1 is described hereinafter with reference to a single label 2 to be retained by one respective receiving portion 12 and to be applied on a corresponding article 3 advanced by carousel 5, and starting from a condition in which such label 2 is transferred from transfer roller 9 to vacuum drum 8 at receiving station R.

In this condition, label 2 is received onto lateral surface 10 and retained by receiving portion 12, in particular retained by the relative pair of pads 13.

As label 2 is circumferentially advanced due to the rotary movement of vacuum drum 8, second sensor 17 detects the angular positioning of label 2, generates a positioning signal correlated with the detection and send this latter signal to control unit 16.

If control unit 16 detects any difference between the detected angular positioning and the nominal angular positioning, i.e. a forward or a backward angular offset, of a given angle W, it controls gluing roller 14 to move away from lateral surface 10 and also controls a backward or a forward rotation, of the same angle W, of vacuum drum 8 relatively to transfer drum 9, so that vacuum drum 8 can be re-phased relatively to transfer drum 9.

If label 2 is still retained by receiving portion 12 after application station A, first sensor 15 detects its presence, accordingly generates a presence signal and send this latter to control unit 16.

Then, control unit 16 commands a stop of labelling machine 1, preferably before label 2 reaches again receiving station R.

If label 2 is applied onto article 3 at application station A, although being non-nominally positioned onto vacuum drum 8, labelling machine 1 is not stopped.

In addition, if second sensor 17 detects a number of labels 2 retained by the corresponding receiving portions 12 with a constant forward/backward angular offset equal to angle W, control unit 16 will control a backward/forward rotation, of the same angle W, of vacuum drum 8 relatively to transfer drum 9, so as to adjust the angular phasing of these latter.

The operation is repeated for each label 2 advanced by vacuum drum 8.

Figure 4:
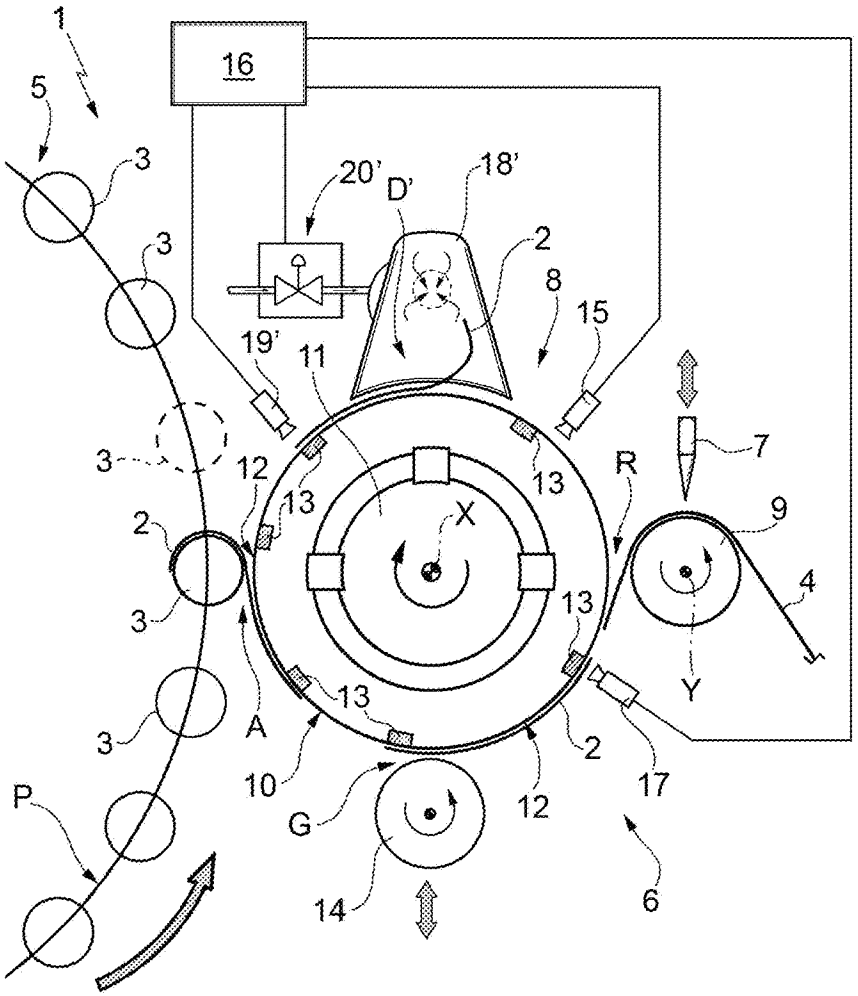
FIG. 4 is a schematic and simplified top view of a labelling machine according to a second embodiment of the present invention.

Number 1' in FIG. 4 indicates as a whole a labelling machine according to a second preferred embodiment of the present invention.

As labelling machine 1' is similar to labelling machine 1, only the differences with respect to this latter will be described, using the same numerals for similar or equivalent parts.

In particular, labelling machine 1' further comprises:

third detection means, in particular a third optical sensor 19' arranged peripherally to vacuum drum 8, in a position downstream of application station A and upstream of first sensor 15, and configured to generate a further presence signal when a label 2 is present onto lateral surface 10 downstream of application station A and upstream of first sensor 15;

extraction means, preferably a pneumatic extractor 18', arranged peripherally to vacuum drum 8, in a position downstream of third sensor 19' and upstream of first sensor 15, and defining a discard station D' for labels 2 which are present downstream of application station A; and activation means 20' configured to activate extractor 18' in response of the further presence signal.

In use, third sensor 19' is configured to generate the further presence signal whenever it detects one label 2 which remains still retained by the respective receiving portion 12, despite having passed application station A, and before they reach first sensor 15.

The further presence signal is then sent to control unit 16, which is configured to correspondingly send a command signal to activation means 20'.

When activation means 20' receive the command signal, they activate extractor 18', which suck in the label 2 which has been detected by third sensor 19'.

This configuration allows to prevent a stop of labelling machine 1', since no presence of any label 2 is detected by first sensor 15 downstream of extractor 18'.

In the case that extractor 18' does not manage to discard labels 2, for example due to an excess of glue which firmly stick such labels 2 onto lateral surface 10, these labels 2 which are further advanced downstream of extractor 18' are detected by first sensor 15, which, as described above for labelling machine 1, determines the stop of labelling machine 1'.

The advantages of labelling machine 1, 1' according to the present invention will be clear from the foregoing description.

In particular, second sensor 17 allows to retrieve information about the nominal or non-nominal positioning of labels 2 at a specific position of such labels 2 during their advancement from receiving station R towards application station A and, therefore, to use such information to perform a troubleshooting of the causes due to which labels 2 are not applied onto articles 3 at application station A in an easy, cost-effective and time-effective manner.

Moreover, the fact that control unit 16 is configured to control a movement of gluing roller 14 away from vacuum drum 8, based on the positioning information provided by second sensor 17, i.e. when labels 2 are non-nominally retained by vacuum drum 8, allows to avoid waste of glue and undesired spreading of glue over vacuum drum 8.

Furthermore, second sensor 17 permits to perform an automatic correction of the phasing between vacuum drum 8 and transfer roller 9.

In addition, the presence of third sensor 19' and extractor 18' avoid a stop of labelling machine 1' in the case a label 2 remains still retained onto vacuum drum 8 downstream of extractor 18.

Clearly, changes may be made to labelling machine 1, 1' as described herein without, however, departing from the scope of protection as defined in the accompanying claims.

In particular, second sensor 17 could be configured to detect not only the angular positioning of labels 2 relatively to the corresponding receiving portions 12, but also an axial positioning of labels 2 relatively to the same receiving portions 12.

In this last case, control unit 16 would be configured to compare such axial positioning with a predetermined nominal axial positioning of labels 2 relatively to receiving portions 12.

Alternatively, second sensor 17 could detect a combination of such angular and axial positioning.

In addition, the transfer element could be defined by a linear conveyor or a roto-translational conveyor configured to receive, retain and convey each single label 2, one after the other, from receiving station R to application station A, during nominal operating conditions. Also, the feeding element configured to feed the sequence of single labels 2 previously cut by knife 7 could be defined by a linear conveyor or a roto-translational conveyor.

In this latter case, the positioning error of labels 2 relatively to their corresponding receiving portions 12 would be defined by a linear quantity, i.e. a linear offset of linear length W.

The invention claimed is:

1. A labelling machine (1, 1') for applying labels (2) onto articles (3) intended to contain a pourable product; said labelling machine (1, 1') comprising:

a conveyor (5) configured to advance a plurality of said articles (3) along a transfer path (P); and a transfer drum (8), arranged peripherally to said conveyor (5) and configured to receive a sequence of single labels (2) one after the other at a receiving station (R), to retain said labels (2) onto a lateral surface (10) thereof and to convey said labels (2), along an advancement direction, towards an application station (A), at which said labels (2) are, in use, released from said lateral surface (10) and are, in use, fed to said conveyor (5) to be applied onto said articles (3);

said labelling machine (1, 1') further comprising first detection means (15), arranged peripherally to said transfer drum (8) in a position downstream of said application station (A) and upstream of said receiving station (R), relatively to said advancement direction, and configured to detect the single labels (2) still retained in use, by said lateral surface (10) downstream of said application station (A) and to generate a presence signal correlated with the presence of said labels (2) still retained in use, by said lateral surface (10) downstream of said application station (A);

further comprising;

a second detection means (17) arranged in a position downstream of said receiving station (R) and upstream of said application station (A), relatively to said advancement direction, and configured to detect a positioning of each label (2) onto said lateral surface (10) and to generate a positioning signal correlated with said positioning of said each label (2);

third detection means (19') arranged in a position downstream of said application station (A) and upstream said first detection means (15) and configured to generate a further presence signal when a label (2) is present onto said lateral surface (10) downstream of said application station (A) and upstream of said first detection means (15);

extraction means (18') for said labels (2), arranged peripherally to said transfer drum (8), in a position operatively downstream of said third detection means (19) and upstream of said first detection means (15), and defining a discard station (D') for said labels (2); and activation means (20') configured to activate said extraction means (18') in response of said further presence signal.

2. The labelling machine as claimed in claim 1, further comprising a control unit (16) configured to receive said positioning signal and to compare said positioning of said label (2) onto said lateral surface (10) with a predetermined nominal positioning of said label (2) onto said lateral surface (10).

3. The labelling machine as claimed in claim 2, wherein said lateral surface (10) comprises at least one receiving portion (12) extending onto said lateral surface (10), advancing, in use, along said advancement direction and configured to receive one label (2) at a time at said receiving station (R);

said second detection means (17) being configured to detect said positioning of said label (2) onto said lateral surface (10) relatively to said receiving portion (12).

4. The labelling machine as claimed in claim 3, wherein said transfer drum (8) comprises at least one pair of successive pads (13) spaced from one another along said lateral surface (10) and defining respective end portions of said receiving portion (12); said pads (13) being configured to retain corresponding end portions of said label (2);

said second detection means (17) being configured to detect said positioning of said label (2) onto said lateral surface (10) relatively to said pads (13).

5. The labelling machine as claimed in claim 3, wherein said control unit (16) is configured to compare said positioning of said label (2) onto said lateral surface (10) relatively to said receiving portion (12) with a predetermined nominal positioning of said label (2) onto said lateral surface (10) relatively to said receiving portion (12).

6. The labelling machine as claimed in claim 5, further comprising gluing means (14) arranged peripherally with respect to said transfer drum (8) and defining a gluing station (G) located downstream of said receiving station (R) and upstream of said application station (A), relatively to said advancement direction; said gluing means (14) being configured to apply glue onto at least a portion of said label (2);

wherein said second detection means (17) are arranged upstream of said gluing station (G) and are configured to detect said positioning of said label (2) onto said lateral surface (10) relatively to said receiving portion (12) when said label (2) is upstream of said gluing station (G).

7. The labelling machine as claimed in claim 6, wherein said gluing means (14) are arranged in a position substantially tangent to said lateral surface (10);

and wherein said control unit (16) is configured to control a movement of said gluing means (14) away from said lateral surface (10) when said positioning detected by said second detection means (17) differs, in use, from said nominal positioning.

8. The labelling machine as claimed in claim 5, further comprising a feed roller (9) arranged peripherally to said transfer drum (8) and configured to feed each label (2) to said transfer drum (8) at said receiving station (R);

wherein said control unit (16) is configured to control an advancement of a given quantity (W) of said transfer drum (8) relatively to said feed roller (9), when said positioning detected by said second detection means (17) for at least one label (2) differs, in use, from said nominal positioning by said given quantity (W).

9. The labelling machine as claimed in claim 8, wherein said second detection means (17) are configured to detect an offset, of said given quantity (W), of said label (2) with respect to said receiving portion (12).

10. The labelling machine as claimed in claim 9, wherein said control unit (16) is configured to control a backward advancement, of said given quantity (W), of said transfer drum (8) relative to said feed roller (9), when said second detection means (17) detect a forward offset, of the same given quantity (W), of said label (2) with respect to said receiving portion (12), relatively to said advancement direction;

and wherein said control unit (16) is configured to control a forward advancement, of said given quantity (W), of said transfer drum (8) relative to said feed roller (9), when said second detection means (17) detect a backward offset, of the same given quantity (W), of said label (2) with respect to said receiving portion (12), relatively to said advancement direction.

11. The labelling machine as claimed in claim 1, wherein said transfer drum comprises a rotary transfer drum (8), rotatable around a first axis (X);

and wherein said positioning of said labels (2) detected by said second detection means (17) is an angular positioning of said labels (2), with respect to said first axis (X), onto said lateral surface (10), and said predetermined nominal positioning is a predetermined angular nominal positioning.

12. The labelling machine as claimed in claim 11, further comprising:

a rotary transfer roller (9) arranged peripherally to said transfer drum (8) and configured to feed each label (2) to said transfer drum (8) at said receiving station (R), said rotary transfer roller (9) rotatable around a second axis (Y) parallel to said first axis (X); and a control unit (16) configured to control an advancement of a given quantity (W) of said transfer drum (8) relatively to said feeding roller (9), where the given quantity (W) is at a given angle, wherein:

said second detection means (17) is configured to detect an offset, of said given angle, of said label (2) with respect to a receiving portion (12), where said offset is an angular offset of said label (2) with respect to said receiving portion (12), relatively to said first axis (X); and said control unit (16) is configured to control a rotation of said given angle (W) of said transfer drum (8) relative to said transfer roller (9), when said angular positioning detected by said second detection means (17) for at least one label (2) differs, in use, from said nominal angular positioning by said given angle (W).

13. A method of labelling articles (3) for containing a pourable product; the method comprising:

advancing a plurality of articles (3) along a transfer path (P);

conveying a succession of single labels (2) one after the other from a receiving station (R) towards an application station (A), at which said labels (2) are applied onto said articles (3), respectively;

detecting the labels (2) which are further advanced from said application station (A) towards said receiving station (R); and generating a control signal when labels (2) are detected during the step of detecting the labels (2);

further comprising:

detecting a positioning of each label (2) downstream of said receiving station (R) and upstream of said application station (A);

generating a positioning signal correlated with said positioning of said label (2) detected during the step of detecting the positioning further detecting the labels (2) which are present downstream of said application station (A) prior to the step of detecting the labels (2);

generating a further presence signal when labels (2) are detected during the step of further detecting the labels (2); and extracting the labels (2) detected during the step of further detecting the labels (2) in response of said further presence signal.

14. The method as claimed in claim 13, further comprising:

comparing said positioning detected during the step of detecting the positioning with a predetermined nominal positioning of said label (2) downstream of said receiving station (R) and upstream of said application station (A).

15. The method as claimed in claim 14, further comprising:

providing gluing means (14) arranged at a gluing station (G) located downstream of said receiving station (R) and upstream of said application station (A), and configured to apply glue onto at least a portion of each label (2);

wherein the step of detecting the positioning is carried out after the labels (2) have passed said receiving station (R) and prior the labels (2) have reached said gluing station (G).

16. The method as claimed in claim 15, further comprising:

excluding any cause occurring upstream of said gluing station (G) due to which a control signal is generated during the step of generating a control signal, if, during the step of comparing, said positioning detected during the step of detecting the positioning coincides with said nominal positioning.

17. The method as claimed in claim 15, further comprising:

conveying said labels (2) from said receiving station (R) to said application station (A) along an advancement direction; and controlling said gluing means (14) to move away from said advancement direction, when said positioning detected during the step of detecting the positioning differs from said nominal positioning.

18. The method as claimed in claim 14, further comprising:

providing a transfer drum (8) configured to receive said labels (2) at said receiving station (R) and to convey said labels (2) at said application station (A); and providing at least one receiving portion (12) extending onto said transfer drum (8) and configured to receive at least one label (2) at a time at said receiving station (R);

wherein the method further comprises:

detecting said positioning of said label (2) onto said transfer drum (8) relatively to said receiving portion (12); and comparing said positioning with said predetermined nominal positioning of said label (2) onto said transfer drum (8) relatively to said receiving portion (12).

19. The method as claimed in claim 18, further comprising:

feeding each label (2) to said transfer drum (8) by means of at least one feed roller (9) provided at said receiving station (R) and arranged peripherally to said transfer drum (8); and controlling an advancement of a given quantity (W) of said transfer drum (8) relatively to said feed roller (9), when said positioning detected at the step of detecting the positioning differs, by said given quantity (W), from said nominal positioning.

* * * * *